US010066432B2

(12) United States Patent
Sanchez

(10) Patent No.: US 10,066,432 B2
(45) Date of Patent: Sep. 4, 2018

(54) DOOR OPENING SYSTEM

(71) Applicant: Ignacio Sanchez, Long Beach, CA (US)

(72) Inventor: Ignacio Sanchez, Long Beach, CA (US)

( * ) Notice: Subject to any disclaimer, the term of this patent is extended or adjusted under 35 U.S.C. 154(b) by 203 days.

(21) Appl. No.: 15/053,013

(22) Filed: Feb. 25, 2016

(65) Prior Publication Data

US 2017/0247925 A1 Aug. 31, 2017

(51) Int. Cl.

*B25D 1/04* (2006.01)
*B25F 1/00* (2006.01)
*E05F 7/00* (2006.01)

(52) U.S. Cl.

CPC ..... *E05F 7/00* (2013.01); *B25D 1/04* (2013.01); *B25F 1/006* (2013.01)

(58) Field of Classification Search

CPC ..... B25F 1/006; B25D 1/04; E05F 7/00
See application file for complete search history.

(56) References Cited

U.S. PATENT DOCUMENTS 348,981 A 6/1888 Jewett
1,042,177 A * 10/1912 Vredenburg ..... B25D 1/04 254/26 R
1,923,964 A * 8/1933 Benton ..... B25F 1/006 7/145
2,072,391 A * 3/1937 Varney, Jr. ..... B60D 1/02 172/272
2,087,148 A 7/1937 Hempy
2,609,962 A * 9/1952 Schultz ..... B67B 7/16 220/274
3,599,255 A * 8/1971 Carroll, Sr. ..... B25F 1/00 254/26 R
3,710,407 A * 1/1973 Reid ..... B21D 1/06 7/144
3,843,981 A * 10/1974 Verest ..... B25B 25/00 254/131
4,287,623 A * 9/1981 Tarran ..... B26B 23/00 7/139
D266,903 S * 11/1982 Tarran ..... D8/105
4,531,274 A * 7/1985 Sanders ..... B25B 27/0035 29/267
D299,414 S * 1/1989 Bajza ..... D8/105
D332,382 S 1/1993 Wescott
5,315,724 A * 5/1994 Trujillo ..... B25F 1/00 7/145
5,344,201 A * 9/1994 Offin ..... B25F 1/00 294/175
5,388,297 A * 2/1995 Ross ..... B67B 7/30 7/156

(Continued)

*Primary Examiner* — Joseph J Hail
*Assistant Examiner* — Arman Milanian

(57) ABSTRACT

A door opening system includes a trailer that has a door and the door has a door handle. A tool is provided and the tool may be manipulated. The tool has a striking surface to strike an object when the tool is swung at the object. The tool has a gripper and the gripper engages the door handle thereby facilitating the door handle to be manipulated. The gripper has a functional width of at least thirty two mm. The tool has a first hook to engage a device thereby facilitating the device to be remotely manipulated. The tool has a tapered end to engage a ratchet thereby facilitating the tool to rotate the ratchet.

5 Claims, 3 Drawing Sheets

(56) References Cited

U.S. PATENT DOCUMENTS

| | | | | |
|---|---|---|---|---|
| 6,568,016 | B1 * | 5/2003 | Hoogland | A62B 3/005 30/308.1 |
| 7,051,390 | B2 | 5/2006 | van Beek | |
| 7,159,260 | B2 | 1/2007 | Hansen | |
| 8,210,584 | B2 | 7/2012 | Hiltz | |
| 8,365,332 | B2 * | 2/2013 | Allen | B66F 15/00 254/18 |
| 8,468,630 | B2 | 6/2013 | Barnhart et al. | |
| D767,965 | S * | 10/2016 | Seeds | D8/76 |
| 9,533,178 | B2 * | 1/2017 | Kao | A62B 3/005 |
| 2002/0062526 | A1 * | 5/2002 | Keldsen | B25B 13/48 7/100 |
| 2006/0156474 | A1 * | 7/2006 | Gillingham | A62B 3/005 7/129 |
| 2009/0000039 | A1 * | 1/2009 | St. John | B25F 1/00 7/138 |
| 2011/0088170 | A1 * | 4/2011 | Crookston | B25D 1/04 7/122 |
| 2011/0113566 | A1 * | 5/2011 | Holbrook | B25F 1/006 7/146 |
| 2013/0025102 | A1 * | 1/2013 | Barnhart | B25F 1/006 29/239 |
| 2014/0173830 | A1 * | 6/2014 | Arthur | B25F 1/006 7/146 |

* cited by examiner

DOOR OPENING SYSTEM

BACKGROUND OF THE DISCLOSURE

Field of the Disclosure

The disclosure relates to opening devices and more particularly pertains to a new opening device for facilitating a mechanical advantage to open a semi trailer door.

SUMMARY OF THE DISCLOSURE

An embodiment of the disclosure meets the needs presented above by generally comprising a trailer that has a door and the door has a door handle. A tool is provided and the tool may be manipulated. The tool has a striking surface to strike an object when the tool is swung at the object. The tool has a gripper and the gripper engages the door handle thereby facilitating the door handle to be manipulated. The gripper has a functional width of at least thirty two mm. The tool has a first hook to engage a device thereby facilitating the device to be remotely manipulated. The tool has a tapered end to engage a ratchet thereby facilitating the tool to rotate the ratchet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
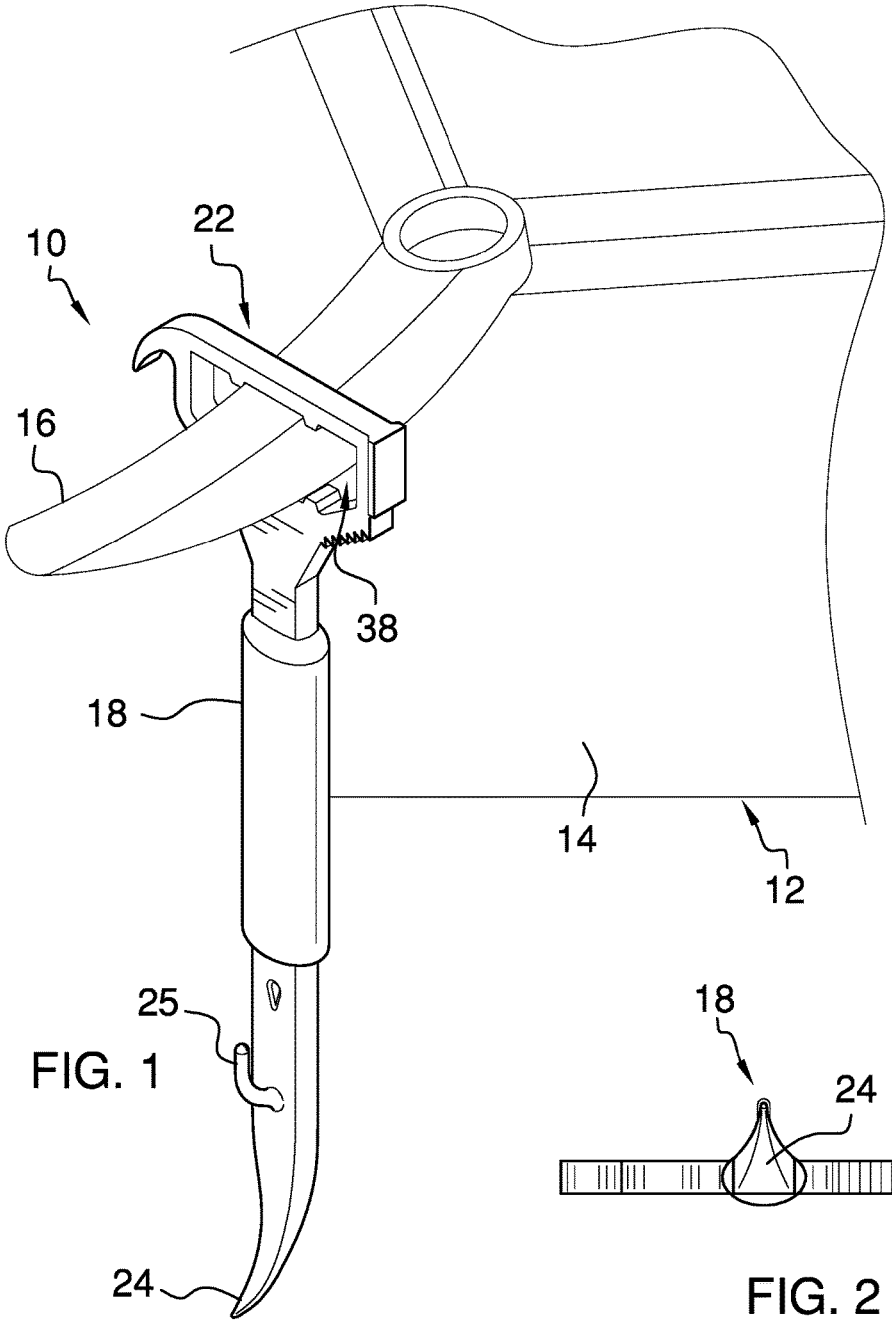
FIG. 1 is a perspective in-use view of a door opening system according to an embodiment of the disclosure.
FIG. 2 is a bottom view of an embodiment of the disclosure.
Figure 3:
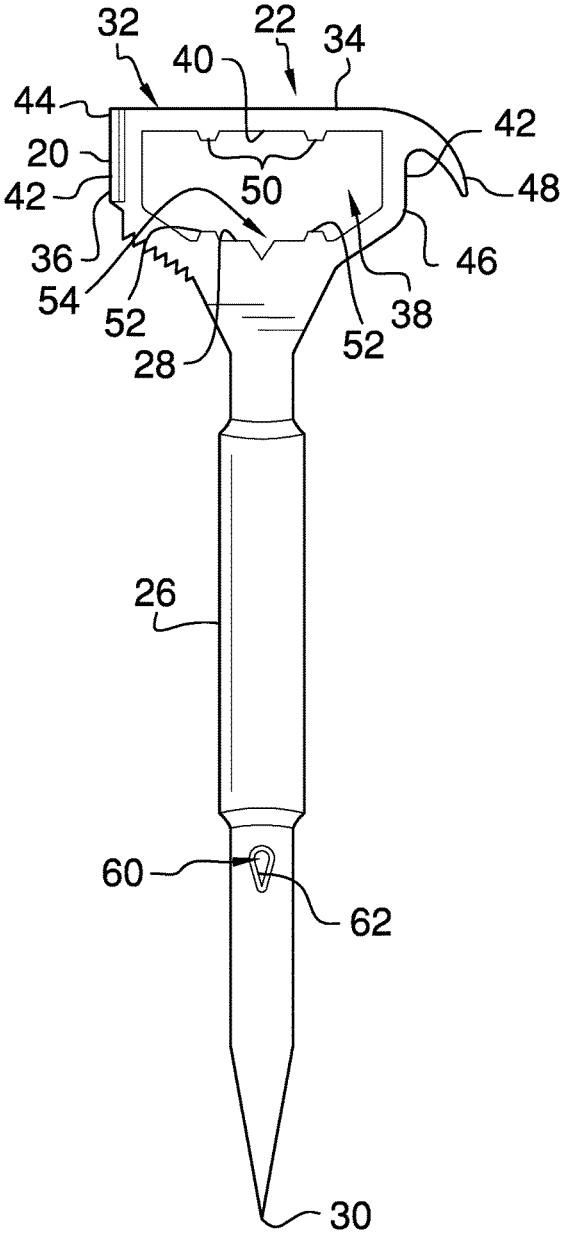
FIG. 3 is a front view of an embodiment of the disclosure.
Figure 4:
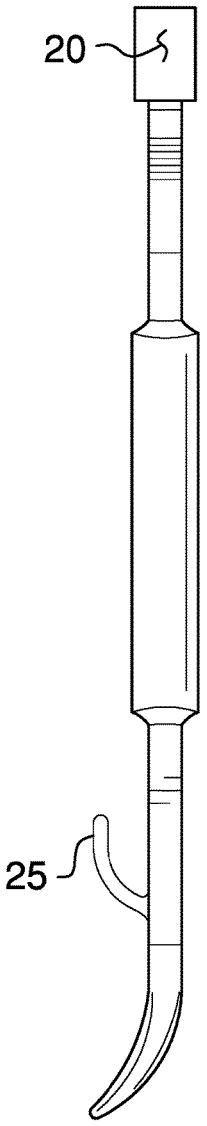
FIG. 4 is a right side view of an embodiment of the disclosure.
Figure 5:
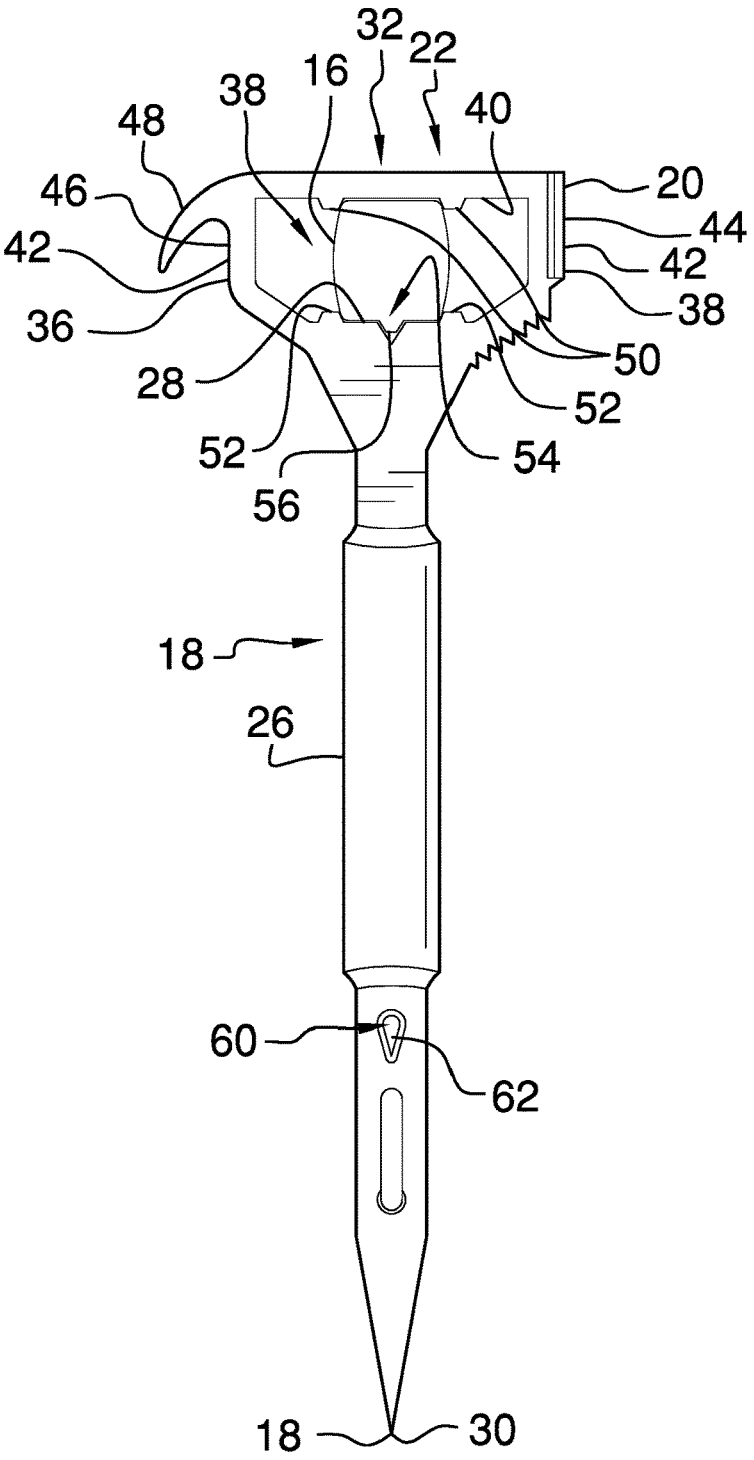
FIG. 5 is a back view of an embodiment of the disclosure.

With reference now to the drawings, and in particular to FIGS. 1 through 5 thereof, a new opening device embodying the principles and concepts of an embodiment of the disclosure and generally designated by the reference numeral 10 will be described.

As best illustrated in FIGS. 1 through 5, the door opening system 10 generally comprises a trailer 12 that has a door 14. The door 14 has a door handle 16. The trailer 12 may comprise a semi trailer or the like. A tool 18 is provided and the tool 18 may be manipulated.

The tool 18 has a striking surface 20 and the striking surface 20 may strike an object when the tool 18 is swung at the object. The tool 18 has a gripper 22 and the gripper 22 selectively engages the door handle 16. Thus, the door handle 16 may be manipulated. The tool 18 has a tapered end 24 and the tapered end 24 may engage a ratchet thereby facilitating the tool 18 to rotate the ratchet. The ratchet may comprise a strap ratchet on the semi trailer or the like. The tool 18 includes a first hook 25.

The tool 18 comprises a handle 26 that has a first end 28 and a second end 30. The second end 30 tapers to a point to define the tapered end 24 of the tool. A head 32 is coupled to the handle 26. The head 32 comprises a central arm 34 extending between a pair of lateral arms 36. The lateral arms 36 are spaced apart from each other. Each of the lateral arms 36 is coupled to the first end 28 of the handle 26. Thus, the head 32 defines a closed loop 38 having the central arm 34 being spaced from the handle 26. The door handle 16 is extended through the closed loop 38.

The central arm 34 has a bottom surface 40. Each of the lateral arms 36 has an outwardly facing surface 42. The pair of lateral arms 36 includes a first lateral arm 44 and a second lateral arm 46. The outwardly facing surface 42 corresponding to the first lateral arm 44 flares outwardly to define the striking surface 20. A second hook 48 extends away from the outwardly facing surface 42 corresponding to the second lateral arm 46. Thus, the second hook 48 may engage an object thereby facilitating the tool 18 to pry the object.

A pair of first tabs 50 is included. Each of the first tabs 50 extends downwardly from the bottom surface 40 of the central arm 34. The first tabs 50 are spaced apart from each other. Each of the first tabs 50 frictionally engages the door handle 16 when the door handle 16 is extended through the closed loop 38. Thus, the head 32 is inhibited from rotating on the door handle 16. The first tabs 50 are spaced at least thirty two mm apart from each other to facilitate a common width of semi trailer door handles.

A pair of second tabs 52 is provided and each of the second tabs 52 extends upwardly from the first end 28 of the handle 26. The second tabs 52 are positioned between the lateral arms 36. The second tabs 52 are spaced apart from each to frictionally engage the door handle 16 when the door handle 16 is extended through the closed loop 38. Each of the second tabs 52 is aligned with an associated one of the first tabs 50.

The first end 28 of the handle 26 has a notch 54 extending downwardly toward the second end 30 of the handle 26. The notch 54 is centrally positioned between the second tabs 52. The notch 54 may have a width of at least nine mm. The door handle 16 may have a ridge 56 running along the door handle 16. The ridge 56 on the door handle 16 is positioned in the notch 54 when the door handle 16 is extended through the closed loop 38. Thus, the first end 28 of the handle 26 is inhibited from rolling on the door handle 16.

The first hook 25 may engage a device thereby facilitating the device to be remotely manipulated. The device may be a third wheel release on a semi tractor or the like. The first hook 25 is coupled to and extends away from the handle 26. The first hook 25 is positioned closer to the second end 30 than the first end 28. The first hook 25 curves upwardly toward the first end 28.

The handle 26 has an aperture 60 extending therethrough. The aperture 60 is positioned closer to the first hook 58 than the first end 28. The aperture 60 has a bounding edge 62. The bounding edge 62 tapers to a point such that the aperture 60 has a teardrop shape. Thus, the aperture 60 may engage a fastener thereby facilitating the tool 18 to remove the fastener from an object. The fastener may be a nail or the like.

In use, the tool 18 may be employed by truck drivers or the like. The tool 18 is manipulated to position the door handle 16 in an open position. The door handle 16 is extended through the closed loop 38. The tool 18 is manipulated to position the ridge 56 on the door handle 16 in the notch 54. The tool 18 is manipulated to position the door handle 16 between the first tabs 50 and the second tabs 52. The tool 18 is manipulated to rotate the door handle 16 outwardly from the door 14. The tool 18 is manipulated to urge the door handle 16 into the open position. The tool 18 is manipulated to position the door handle 16 in a closed position and to rotate the door handle 16 toward the door 14. The tool 18 facilitates a mechanical advantage for a user thereby facilitating a user with a physical limitation to open and close the door handle 16.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A door opening system comprising:

a trailer having a door, said door having a door handle; and a tool being configured to be manipulated, said tool having a striking surface wherein said striking surface is configured to strike an object when said tool is swung at the object, said tool having a gripper, said gripper engaging said door handle thereby facilitating said door handle to be manipulated, said gripper having a functional width of at least thirty two mm, said tool having a first hook wherein said first hook is configured to engage a device thereby facilitating the device to be remotely manipulated, said tool having a tapered end wherein said tapered end is configured to engage a ratchet thereby facilitating said tool to rotate the ratchet, wherein said tool comprises a handle having a first end and a second end, said second end tapering to a point to define said tapered end of said tool, a head being coupled to said handle, said head comprising a central arm extending between a pair of lateral arms, said lateral arms being spaced apart from each other, each of said lateral arms being coupled to said first end of said handle such that said head defines a closed loop having said central arm being spaced from said handle, said door handle being extended through said closed loop, said central arm having a bottom surface, each of said lateral arms having an outwardly facing surface, said pair of lateral arms including a first lateral arm and a second lateral arm, a pair of first tabs, each of said first tabs extending downwardly from said bottom surface of said central arm, said first tabs being spaced apart from each other, each of said first tabs frictionally engaging the door handle when the door handle is extended through said closed loop, said first tabs being spaced at least thirty two mm apart from each other, and a pair of second tabs, each of said second tabs extending upwardly from said first end of said handle, said second tabs being positioned between said lateral arms, said second tabs being spaced apart from each other, each of said second tabs frictionally engaging the door handle when the door handle is extended through said closed loop, each of said second tabs being aligned with an associated one of said first tabs.

2. The system according to claim 1, wherein said first end of said handle has a notch extending downwardly toward said second end, said notch being centrally positioned between said second tabs, said door handle being positioned in said notch when said door handle is extended through said closed loop.

3. The system according to claim 1, wherein said first hook is coupled to and extends away from said handle, said first hook being positioned closer to said second end than said first end, said first hook curving upwardly toward said first end.

4. The system according to claim 1, wherein said handle has an aperture extending therethrough, said aperture being positioned closer to said first hook than said first end, said aperture having a bounding edge, said bounding edge tapering to a point such that said aperture has a teardrop shape wherein said aperture is configured to engage a fastener thereby facilitating said tool to remove the fastener from an object.

5. A door opening system comprising:

a trailer having a door, said door having a door handle; and a tool being configured to be manipulated, said tool having a striking surface wherein said striking surface is configured to strike an object when said tool is swung at the object, said tool having a gripper, said gripper engaging said door handle thereby facilitating said door handle to be manipulated, said tool having a first hook wherein said first hook is configured to engage a device thereby facilitating the device to be remotely manipulated, said tool having a tapered end wherein said tapered end is configured to engage a ratchet thereby facilitating said tool to rotate the ratchet, said tool comprising:

a handle having a first end and a second end, said second end tapering to a point to define said tapered end of said tool, and a head being coupled to said handle, said head comprising;

a central arm extending between a pair of lateral arms, said lateral arms being spaced apart from each other, each of said lateral arms being coupled to said first end of said handle such that said head defines a closed loop having said central arm being spaced from said handle, said door handle being extended through said closed loop, said central arm having a bottom surface, each of said lateral arms having an outwardly facing surface, said pair of lateral arms including a first lateral arm and a second lateral arm, said outwardly facing surface corresponding to said first lateral arm flaring outwardly to define said striking surface, a second hook extending away from said outwardly facing surface corresponding to said second lateral arm wherein said second hook is configured to engage an object, and a pair of first tabs, each of said first tabs extending downwardly from said bottom surface of said central arm, said first tabs being spaced apart from each, each of said first tabs frictionally engaging said door handle when said door handle is extended through said closed loop, said first tabs being spaced at least thirty two mm apart from each other;

a pair of second tabs, each of said second tabs extending upwardly from said first end of said handle, said second tabs being positioned between said lateral arms, said second tabs being spaced apart from each other, each of said second tabs frictionally engaging said door handle when said door handle is extended through said closed loop, each of said second tabs being aligned with an associated one of said first tabs, said first end of said handle having a notch extending downwardly toward said second end, said notch being centrally positioned between said second tabs, said door handle being positioned in said notch when said door handle is extended through said closed loop;

said first hook being coupled to and extending away from said handle, said first hook being positioned closer to said second end than said first end, said first hook curving upwardly toward said first end; and said handle having an aperture extending therethrough, said aperture being positioned closer to said first hook than said first end, said aperture having a bounding edge, said bounding edge tapering to a point such that said aperture has a teardrop shape wherein said aperture is configured to engage a fastener thereby facilitating said tool to remove the fastener from an object.

* * * * *